United States Patent [19]

Stewart et al.

[11] Patent Number: 4,596,097

[45] Date of Patent: Jun. 24, 1986

[54] MULTIPLE-DWELLING STRUCTURE

[76] Inventors: Jerry W. Stewart, 7626 Pebblestone, Dallas, Tex. 75230; W. Bryan Thruston, 9611 Knobby Tree, Dallas, Tex. 75243

[21] Appl. No.: 525,103

[22] Filed: Aug. 22, 1983

[51] Int. Cl.[4] ..... E02D 27/00

[52] U.S. Cl. ..... 52/185; 52/236.3

[58] Field of Search ..... 52/234, 236.3, 236.4, 52/236.5, 236.6, 236.7, 236.9, 79.2, 79.3, 169.2, 169.3, 185

[56] References Cited

U.S. PATENT DOCUMENTS

| | | | |
|---|---|---|---|
| 3,656,266 | 4/1972 | Tylius | 52/79.2 X |
| 3,724,143 | 4/1973 | Paukulis | 52/79.2 |
| 4,041,661 | 8/1977 | Hurwitz | 52/236.4 |
| 4,345,407 | 8/1982 | Fishman | 52/234 X |

FOREIGN PATENT DOCUMENTS

| | | | |
|---|---|---|---|
| 585731 | 10/1959 | Canada | 52/236.3 |

OTHER PUBLICATIONS

*Portfolio of Current Architecture,* Oct. 1932, "Models of the Four Basic Types of Hillside Housing", p. 232.

*Primary Examiner*—John E. Murtagh
*Assistant Examiner*—Richard E. Chilcot, Jr.
*Attorney, Agent, or Firm*—Kenneth R. Glaser

[57] ABSTRACT

A multiple-dwelling structure comprising upper and lower individual dwelling units in stacked relationship, both upper and lower units being positioned directly above the garage areas for both units. The garage areas for each unit are positioned essentially adjacent one another, but on a graded surface such that the level of the garage area associated with the lower dwelling unit is approximately one-half story below the level of the garage area associated with the upper dwelling unit. Both dwelling units are on a split-level plan. Each dwelling unit is connected to its respective garage area by an individual passageway or stairway that is unique to the respective dwelling unit and independent of the stairway interconnecting the garage area and the living area of the other dwelling unit. Each of the respective unique stairways interconnects the garage area and the lower level of the split-level dwelling unit, the living, kitchen and dining area thereof, in a manner such that the maximum distance between the level of the garage floor and the lower unit is one story, and the maximum distance between the level of the garage floor and the upper unit is one and one-half stories. Each dwelling unit, being provided with a unique stairway connecting the garage areas and living areas, which stairway is independent of the other dwelling unit and the stairway interconnecting the garage area and living area of the other dwelling unit, ensures the utmost physical privacy to the occupants of each unit, while at the same time permitting stacking of dwelling units to increase the density of such dwelling units per unit area of available land.

9 Claims, 16 Drawing Figures

MULTIPLE-DWELLING STRUCTURE

BACKGROUND OF THE INVENTION

1. Field of the Invention

The present invention relates to a multiple-dwelling structure wherein a plurality of individual dwellings are constructed in stacked fashion, one on top of the other, and more particularly to a multiple-dwelling structure having an upper and lower unit positioned vertically with respect to one another and directly above respective garage areas.

2. Description of the Prior Art

Multiple-dwelling structures in common use today are of the typical apartment or condominium style, wherein "flats" are stacked one upon the other, and wherein a common garage area is shared by all. Additionally, some of the "flat" type structures incorporate common hallways or passageways to the respective main entrances thereof, in addition to the common passageways or walkways connecting the common parking area to the individual dwelling unit.

Dwelling structures of the "townhouse" type generally have private garage areas and private walkways connecting the garage area and dwelling unit; however, typical "townhouse" units are not stacked one upon the other, but rather are generally two story units having the bedroom area(s) directly above the living, kitchen or garage area.

The drawbacks of these two typical types of multiple dwelling structures are that (1) the condominium type structures lack sufficient privacy and security in that they utilize common parking areas and shared walkways, and (2) the townhouse type, while having a greater degree of privacy, generally makes very inefficient use of the land area.

It is therefore a principal object of the present invention to provide a multiple-dwelling structure which affords large degree of personal privacy and security, as well as providing a high dwelling unit per given area density.

It is another object of the present invention to provide such a multiple-dwelling structure that includes a private garage area for each dwelling unit.

It is a still further object of the present invention to provide a multiple-dwelling structure of the stacked, multiple story type, having separate passageways uniquely connecting the individual dwelling units with their respective garage areas, thereby optimizing the privacy and security of each individual dwelling unit, and maximizing efficient use of land area.

SUMMARY OF THE INVENTION

The present invention provides a multiple-dwelling structure wherein a plurality of individual dwelling units are constructed in stacked fashion, one on top of the other, with the garage areas to each being preferably positioned below both units on graded terrain, generally in end-to-end relationship. Each of the so-stacked units includes a separate stairway uniquely interconnecting its living area with its garage area, the stairway associated with the lower unit being separate and isolated from the stairway associated with the upper unit. In accordance with one embodiment of the invention, each dwelling unit additionally includes a second stairway, preferably external, leading from the ground level of the garage up approximately one-half story to the main entranceway of that dwelling unit.

In accordance with a specific feature of the invention, the ground level of the garage communicating with the upper level unit is at a higher grade than the ground level of the garage communicating with the lower level unit, thus reducing the vertical distance to be traversed to the upper level unit. In particular, such grading is maintained to be at least a half story differential, thus limiting the vertical distance between the ground level of the garage for the upper unit and the living area of the upper unit to no more than one and one-half stories.

In accordance with the present invention, individual units of a multiple dwelling structure incorporate separate, unique stairways interconnecting the respective garage areas and dwelling units in a manner to ensure privacy and security of each individual dwelling unit, the structure having one dwelling unit stacked above the other, both being positioned directly over the garage areas for both, thus maximizing the density of dwelling units per given unit area of land.

BRIEF DESCRIPTION OF THE DRAWINGS

For a detailed description of preferred embodiments of the present invention, reference is made to the accompanying drawings in which, FIG. 1A a perspective view of the ground level segment of a first preferred embodiment of the multiple-dwelling structure of the present invention, showing the two garage units associated with the upper and lower dwelling units.

DETAILED DESCRIPTION OF THE INVENTION

Figure 1A:
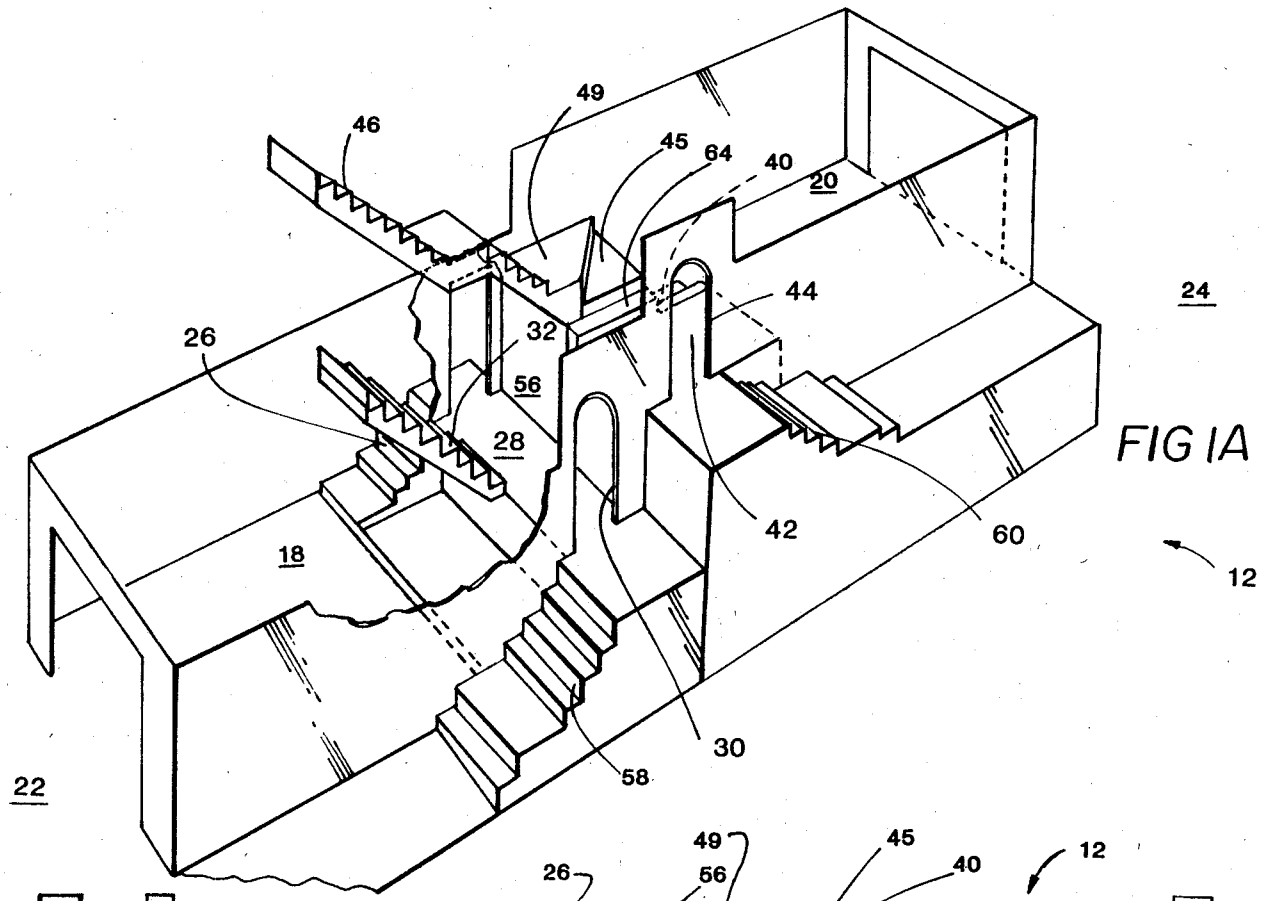
FIG. 1B is a perspective view of the lower dwelling unit of the structure shown in FIG. 1A.
FIG. 1C is a perspective view of the upper dwelling unit of the structure shown in FIG. 1A.
Figure 2A:
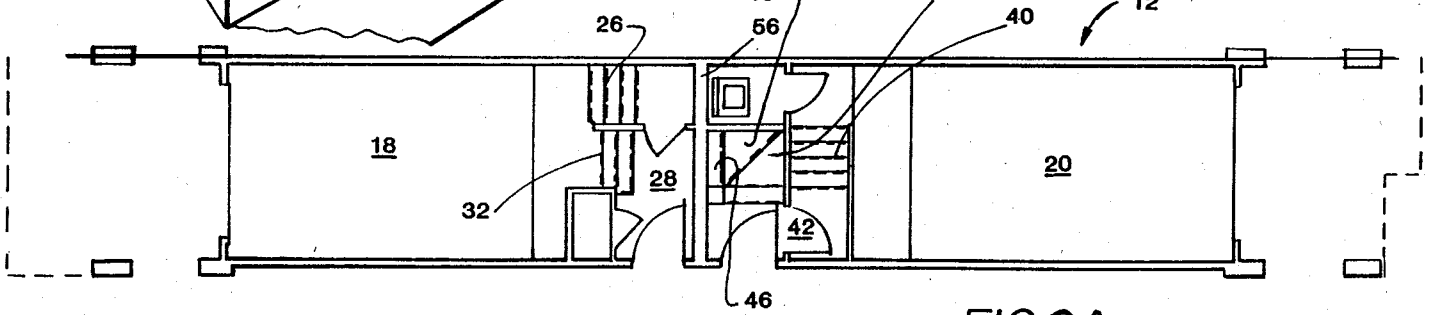
FIG. 2A is a plan view of the segment of the structure shown in FIG. 1A.
Figure 1B:
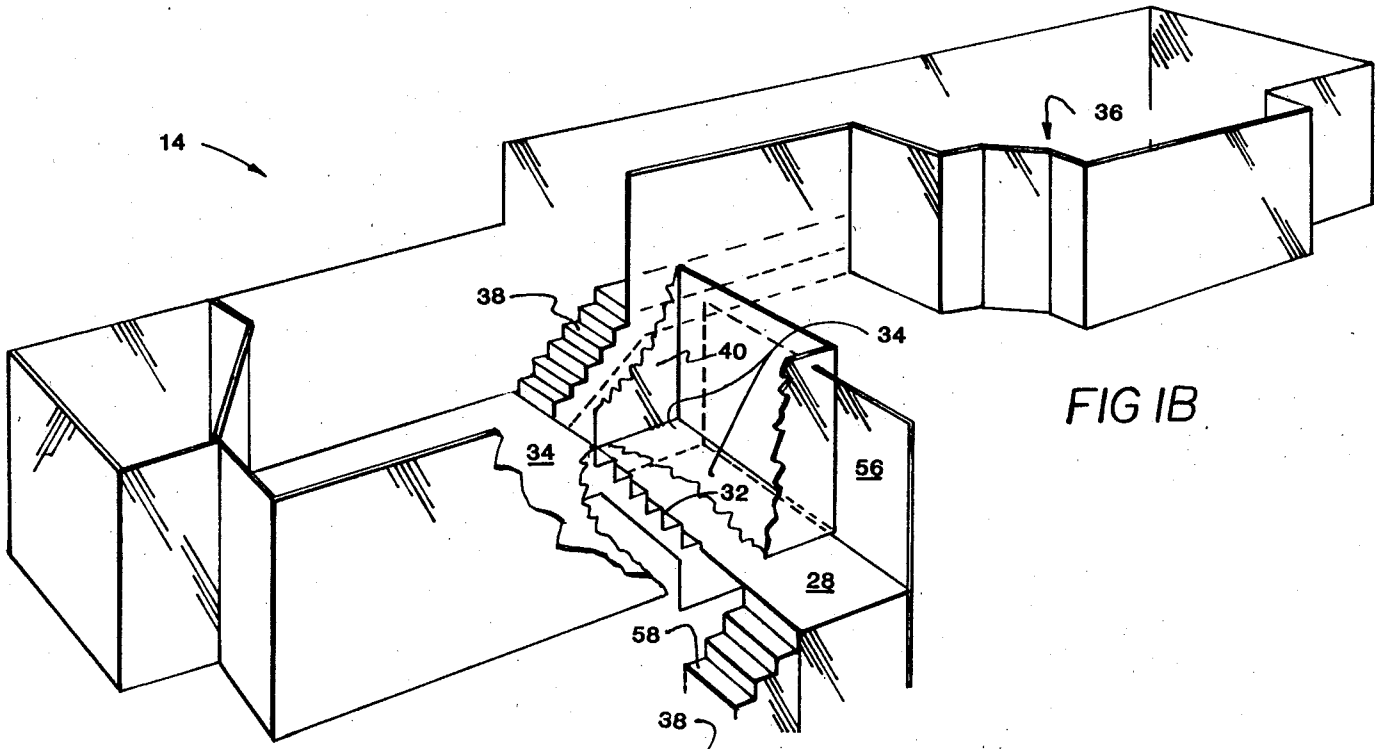
Figure 1C:
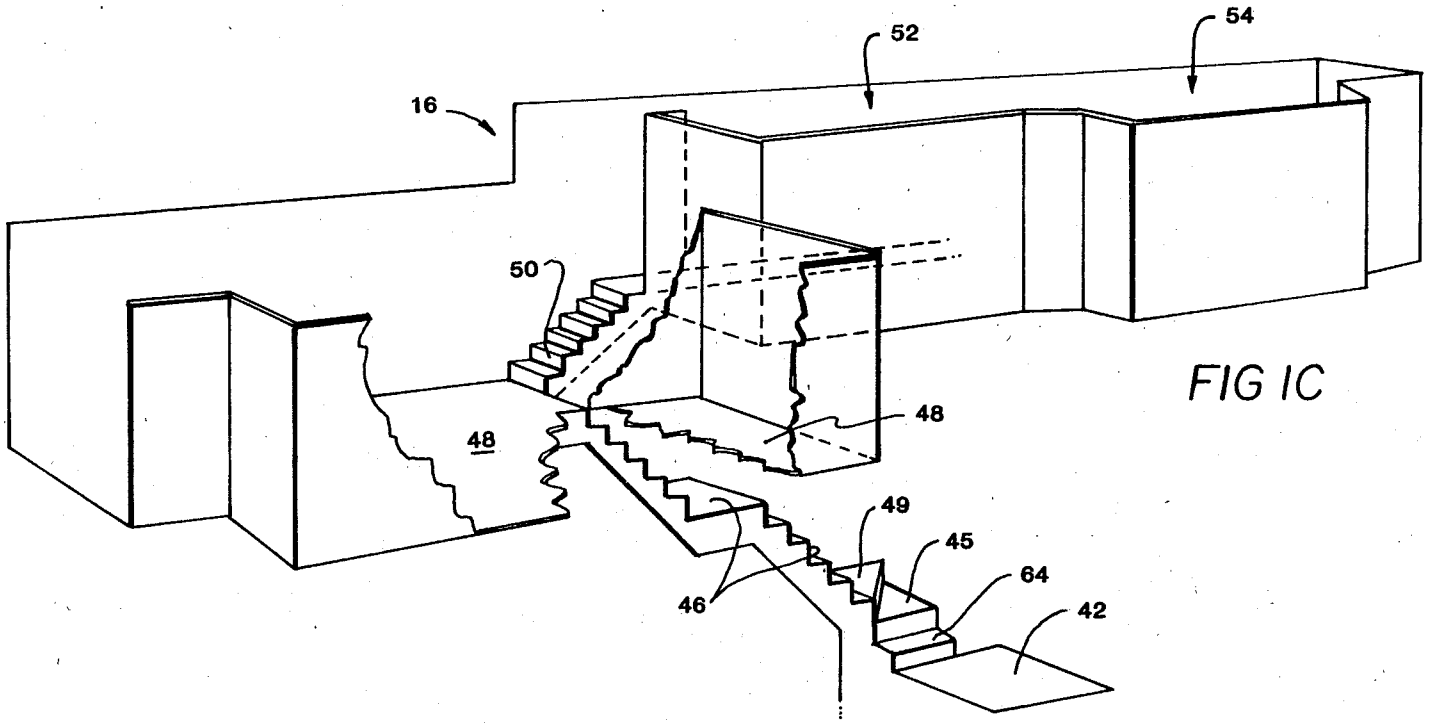

Turning now to the drawings, wherein like parts are indicated throughout the specification and drawings with the same reference numerals, and more specifically to FIGS. 1A, 1B and 1C, a first preferred embodiment of the multiple-dwelling structure of the present invention is shown. It will be appreciated that the multiple-dwelling structure is shown in exploded pictorial form in FIGS. 1A, 1B and 1C, and that it is to be understood that the structure is constructed to be stacked in that order, i.e., the ground level portion which is the garage unit 12 (FIG. 1A) is constructed first, with the lower dwelling unit 14 (FIG. 1B) constructed directly above the garage unit, and the upper dwelling unit 16 (FIG. 1C) is constructed directly above the lower dwelling unit. To aid in the understanding the layout of the respective units 12, 14 and 16, the plans of said units are shown at FIGS. 2A, 2B and 2C, respectively.

Figure 3:
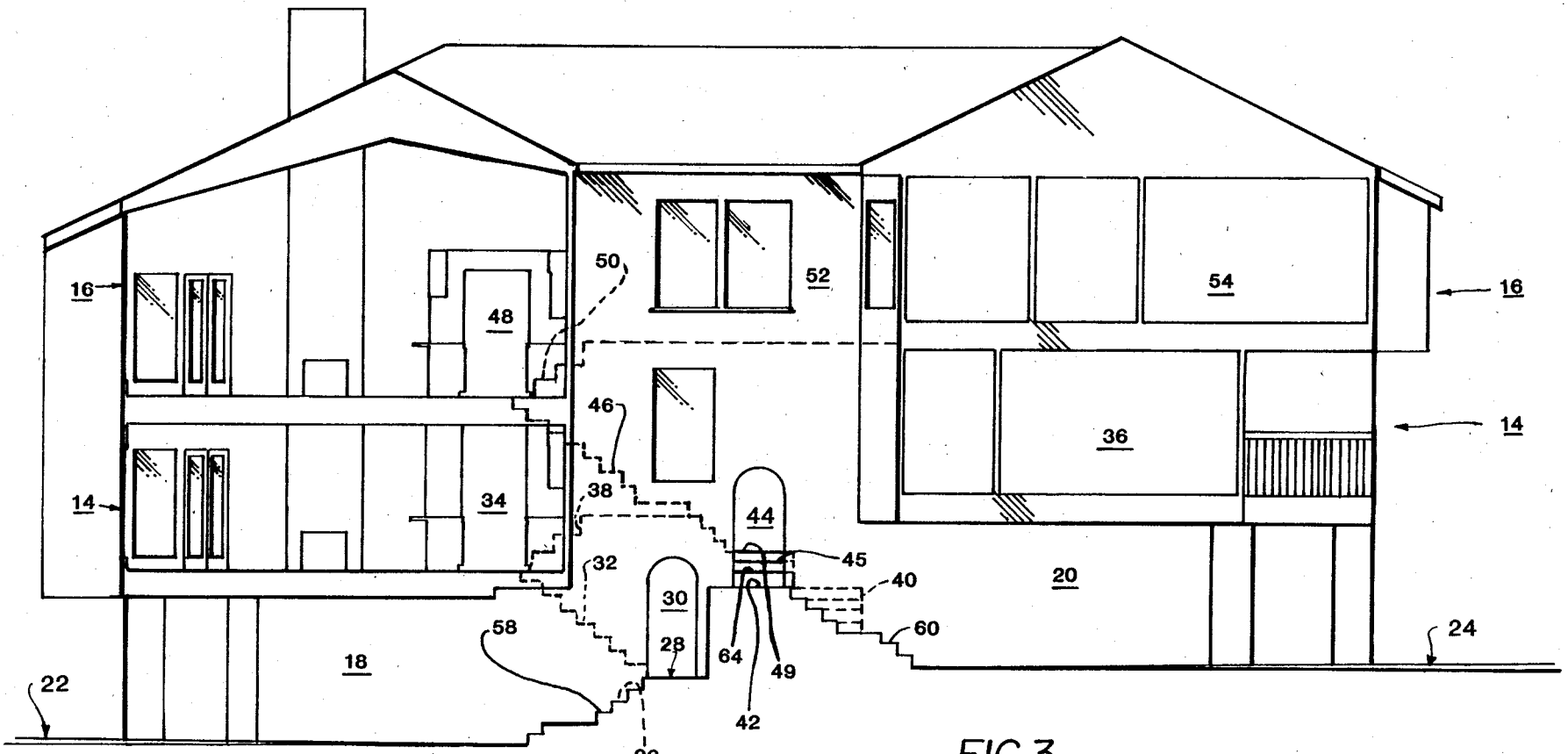
FIG. 3 is a side elevational view of the first preferred embodiment of the multiple-dwelling structure of the present invention.

The multiple-dwelling structure of the present invention incorporates a dual ground level garage unit 12 (FIG. 1A) having a lower garage 18, associated with the lower dwelling unit 14, and an upper garage area 20 associated with the upper dwelling unit 16. As shown in FIG. 1A, and as best shown in FIG. 3, the lower garage area 18 is at a first ground level or grade 22, and the upper garage area 20 is at a second ground level or grade 24 slightly elevated from the first ground level. These separate ground levels 22, 24 are attained by selective grading of the land prior to beginning construction on the multiple-dwelling structure of the present invention. As a particular advantageous feature, the second ground level 24 is at least one-half story higher than the first ground level 22, in order that the vertical distance between the floor of garage 20 and the floor of the entranceway of the upper dwelling unit 16 be no more than one and one-half stories. Furthermore, maintaining the grade differential at approximately one-half story limits the vertical distance between living levels of any one unit to approximately one-half story.

Referring again to FIG. 1A, the lower garage area 18 has a staircase 26 leading up from the floor of the garage to an intermediate plaza area 28. As best shown in FIG. 3, the level of this plaza area 28 is very close to that of the second ground level 24 (i.e., approximately one-half story above the first ground level 22). The lower unit plaza area 28 also includes a main entranceway 30 for providing easy access equally to the lower unit garage area 18 and the lower dwelling unit 14 as will be described in greater detail hereinbelow.

Figure 2B:
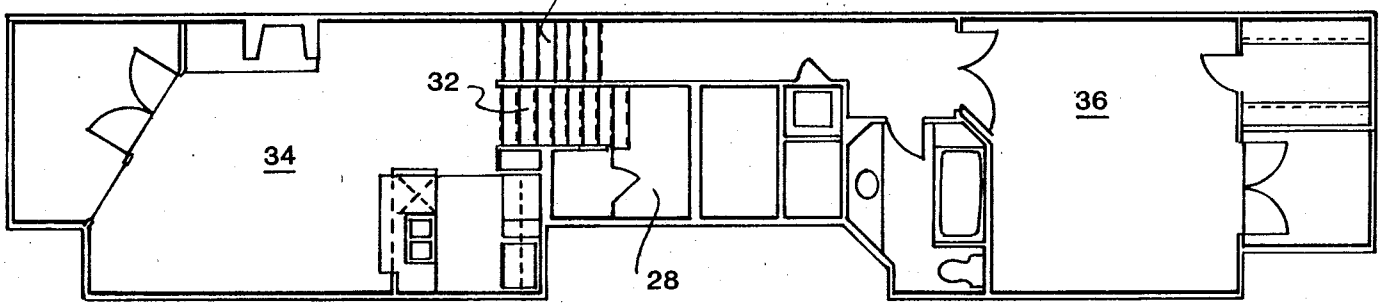
FIG. 2B is a plan view of the unit shown in FIG. 1B.
Figure 2C:
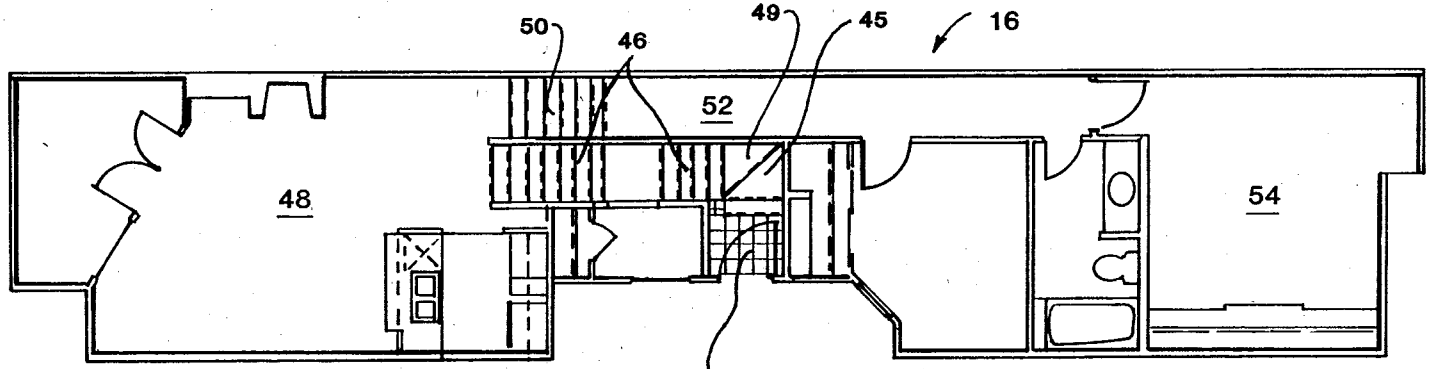
FIG. 2C is a plan view of the unit shown in FIG. 1C.

As best shown in FIGS. 1B, 2B and 3, the lower dwelling unit 14 includes a second stairway 32 interconnecting the lower unit plaza area 28 with the lower dwelling unit 14. Those skilled in the art will readily appreciate that the staircases leading from the lower garage area 18 to the lower dwelling unit 14, and the intermediate plaza area 28 associated therewith, define a separate, unique stairway interconnecting the garage area and the dwelling unit which is not in common with or shared with any other passageway or walkway connecting various parts of the upper dwelling unit 16. This second stairway 32 leads up from the plaza area 28 to the living, dining and kitchen area of the lower dwelling unit, generally illustrated at 34, which is positioned, as shown, directly above the lower garage area 18, and at a first occupied level above the garage area approximately one-half story higher than the lower unit plaza area 28. In this manner, from the entry level at the main entranceway 30, it is approximately one-half story down to the ground level of the garage 18 and approximately one-half story up to the first occupied level of the lower unit living, dining and kitchen area 34 via the unique staircase 26, 32.

Referring again to FIGS. 1B and 2B, the lower dwelling unit 14 also includes a bedroom area 36 at a second occupied level approximately one-half story up from the level of the living, dining, kitchen area 34. These two areas of the lower dwelling unit 34, 36 are interconnected by a staircase 38 which leads from the living, dining and kitchen area up to a hallway leading into the bedroom area 36. The bedroom area 36 is positioned directly above the garage area 20 for the upper dwelling unit 16. As best shown in FIG. 3, the bedroom area 36 is at an elevation approximately one-half story above that of the lower unit living, dining and kitchen area 34.

Returning once again to FIGS. 1A and 2A, the upper garage area 20 associated with the upper dwelling unit 16 is shown in essentially spaced end-to-end relationship with the lower garage area 18. As in the lower garage area 18, the upper garage area 20 includes a first staircase 40 leading from the second ground level 24 of the upper garage to a upper unit plaza area 42. As best shown in FIG. 3, this upper unit plaza area 42 is at a level approximately one-half story above the second ground level 24, therefore approximately on the same level with the lower unit living, dining and kitchen area 34. Additionally, as shown in the drawings, the upper dwelling unit 16 also includes a main entranceway 44 opening into the plaza area 42. The plaza area 42 further includes a second staircase 46 leading up from the upper unit plaza area 42 to the upper dwelling unit 16 (see FIGS. 1C and 2C). As in the case of the lower dwelling unit 14, this staircase 46 leads up to and opens into the upper unit living, dining and kitchen area 48. Those skilled in the art will readily appreciate that each of the sets of staircases comprising the passageways connecting respective garage areas and living areas (26, 32 in the lower dwelling unit 14, and 40, 46 in the upper dwelling unit 16) is unique or exclusive to its particular dwelling unit in that the set of staircases leading to the upper unit is independent, separate and apart from the set of staircases leading to the lower dwelling unit.

As shown in FIGS. 1A and 2A, the stairway 46 includes a twister 45, 49 to enable the stairway to turn the corner from the plaza area 42 up to the upper unit living, dining and kitchen area 48. A third staircase 50 (See FIG. 1C) leads from the living, dining and kitchen area 48 via a hallway 52 into the upper unit bedroom area 54, as in the corresponding lower unit staircase 38; the bedroom area of the upper unit is at a level approximately one-half story above the level of the living, dining and kitchen area, as in the lower unit 14, and is positioned directly above the lower unit.

It should be noted that because the upper unit main entranceway 44 is at a level approximately one-half story above the ground level 24 entrance to the upper garage area 20, the distance from the upper level main entranceway 44 to the upper level living, dining and kitchen area 48 is approximately one story. In this manner, those residents of the upper unit (effectively, the second story unit) travel up only one story from the main entranceway to the living, dining, kitchen area, as opposed to two stories of travel for those residents living in second story units having parking areas below the first story unit.

As best shown in FIG. 2A, the garage areas 20, 22 are separated by a wall or partition 56 for total separation and privacy. As noted, adjacent this wall 56, and on either side thereof, are the respective lower and upper unit plaza areas 28, 42, and the respective lower and upper unit main entranceways 30, 44, leading thereinto at a level of approximately one-half story above the respective ground levels of the upper and lower garage areas 22, 24. As shown, the lower and upper units further include respective outer stairways 58, 60 that lead up from respective first and second ground levels 22, 24 to the lower and upper unit plaza areas 28, 42. Alternatively, the land could be contoured in this particular area to have a sloping sidewalk to replace either or both of the outer stairways 58, 60, or parts thereof, to result in the same effect of each of the lower and upper dwelling units having the entranceway 30, 44 at a level approximately one-half story above the respective garage levels. From these respective levels, in the preferred embodiment, it is approximately one-half story up to the lower unit living, dining and kitchen area 34, and in the upper unit, it is approximately one story up to the living, dining and kitchen area 48.

Figure 4:
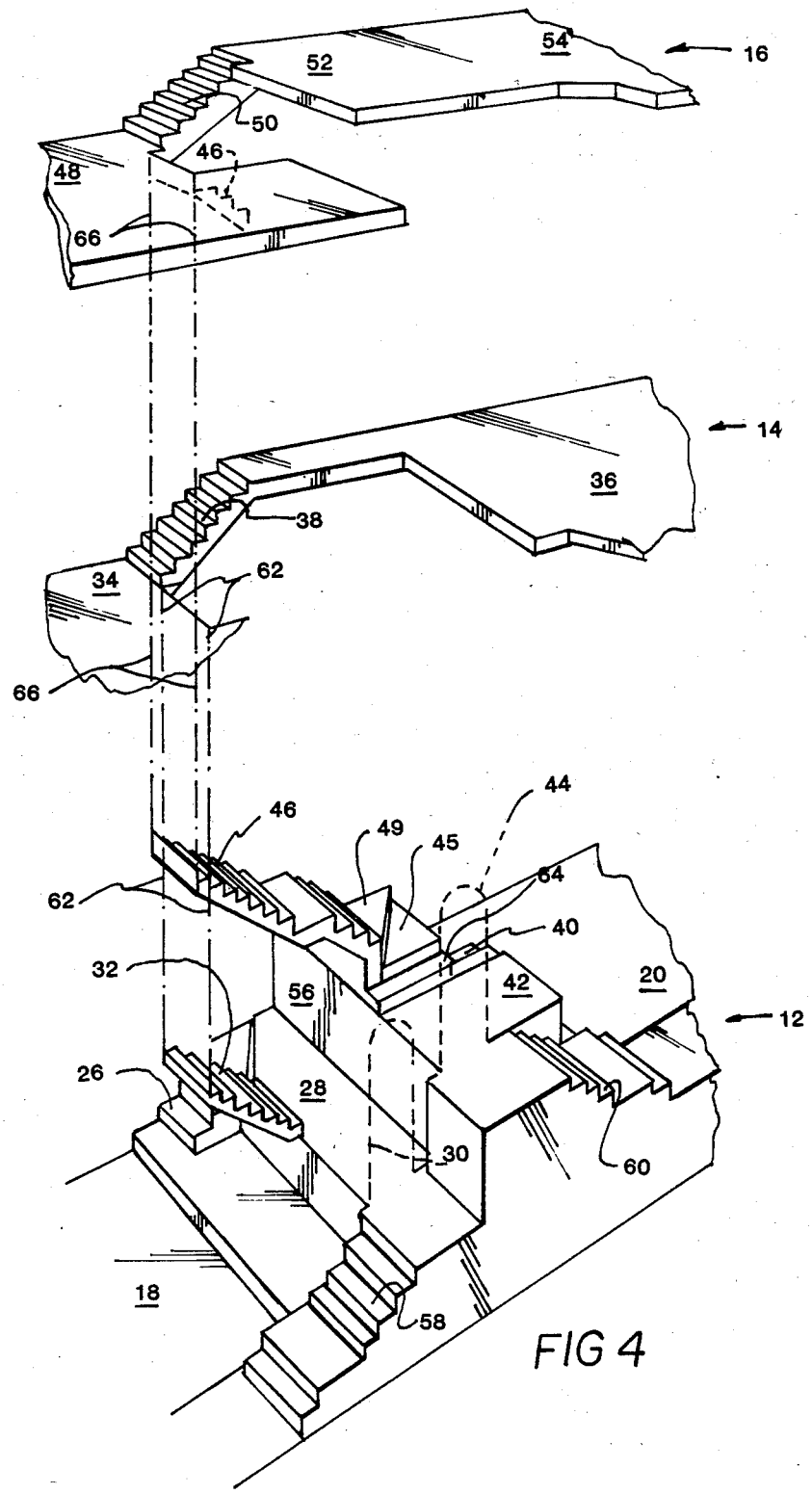
FIG. 4 is a perspective view of the floors of the garage unit, lower unit and upper unit, showing the relationship of the stairways interconnecting the respective garage areas and living areas.
Figure 5A:
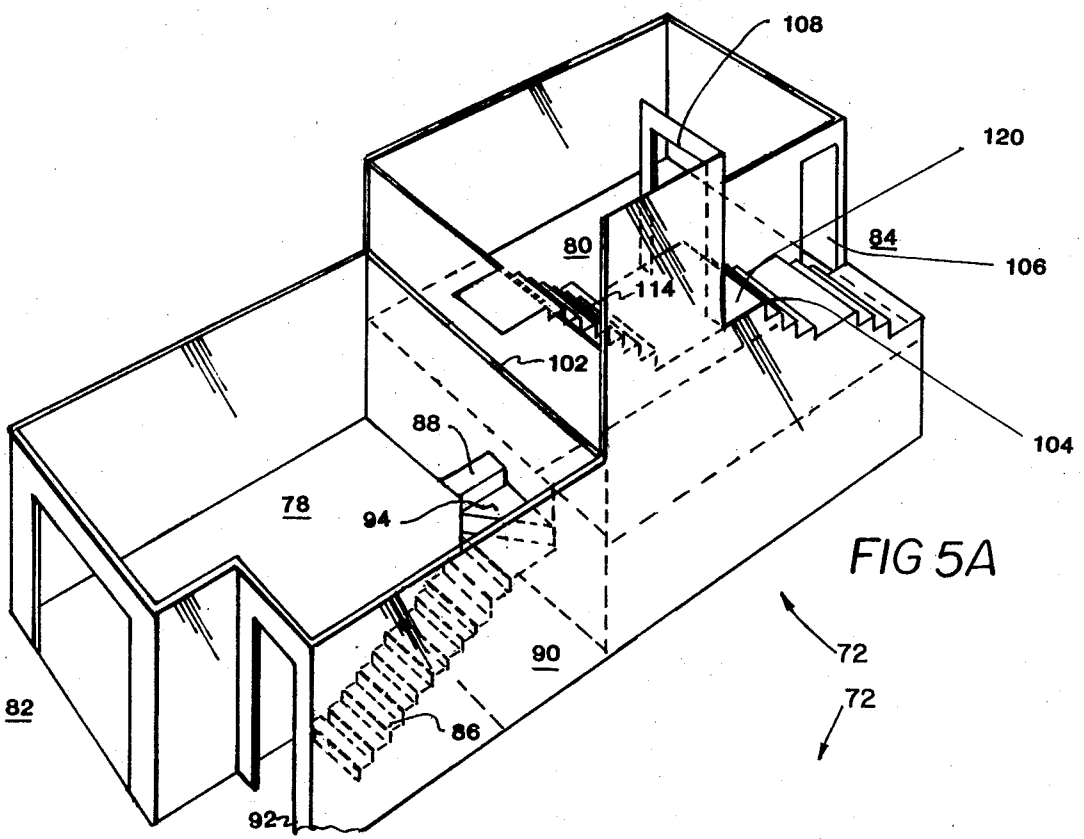
FIG. 5A is a perspective view of the ground level segment of a second preferred embodiment of the multiple-dwelling structure of the present invention.
Figure 6A:
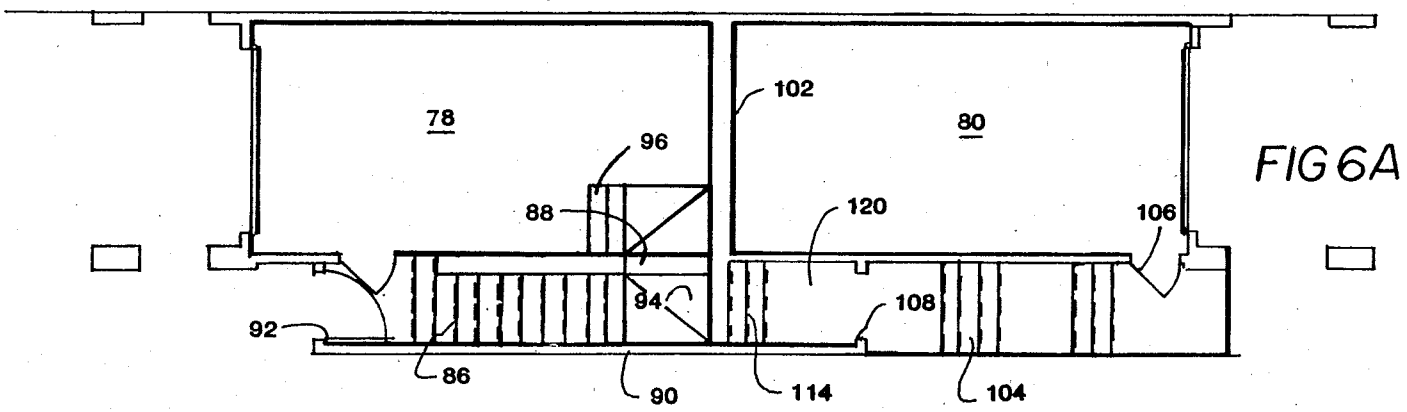
FIG. 6A is a plan view of the segment of the structure shown in FIG. 5A.
Figure 5B:
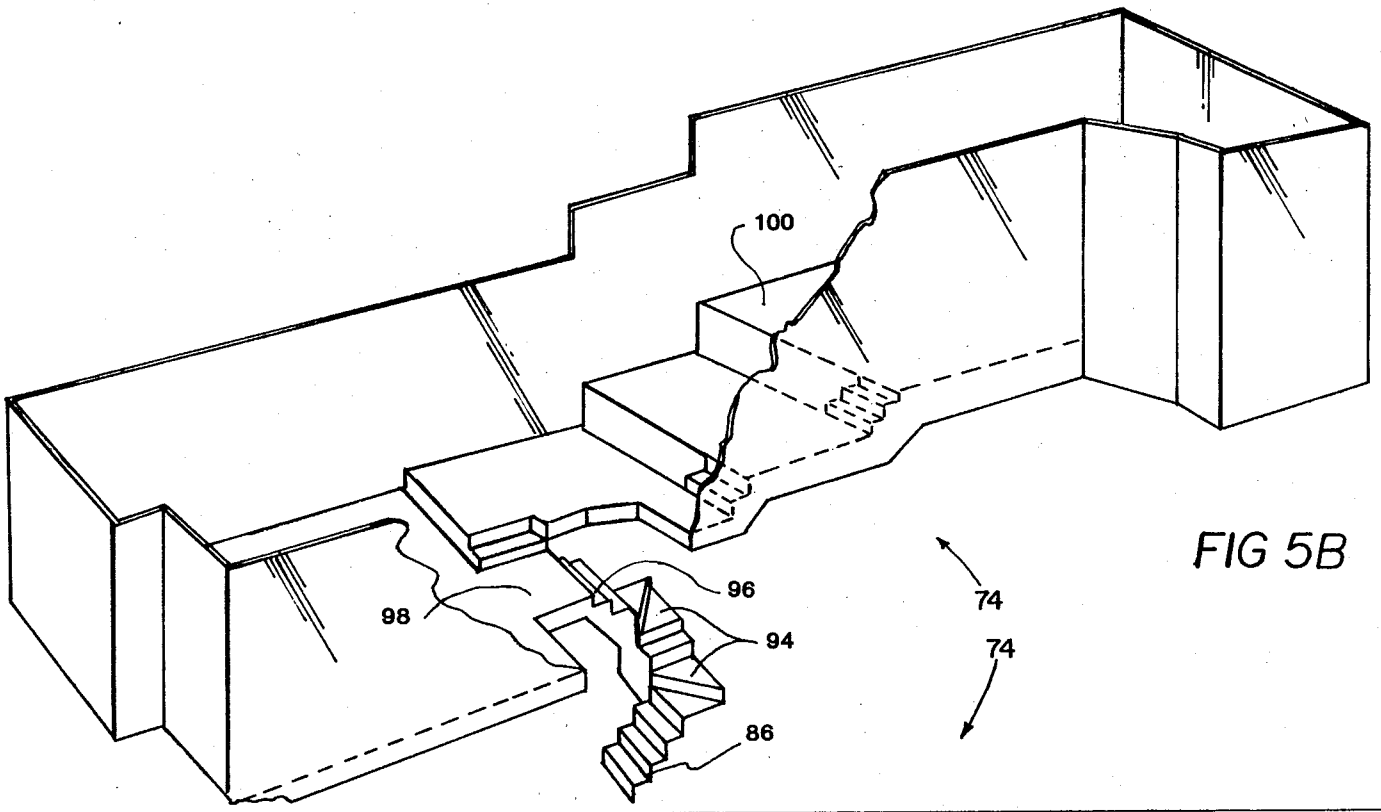
FIG. 5B is a perspective view of the lower dwelling unit of the embodiment of the structure shown in FIG. 5A.
Figure 6B:
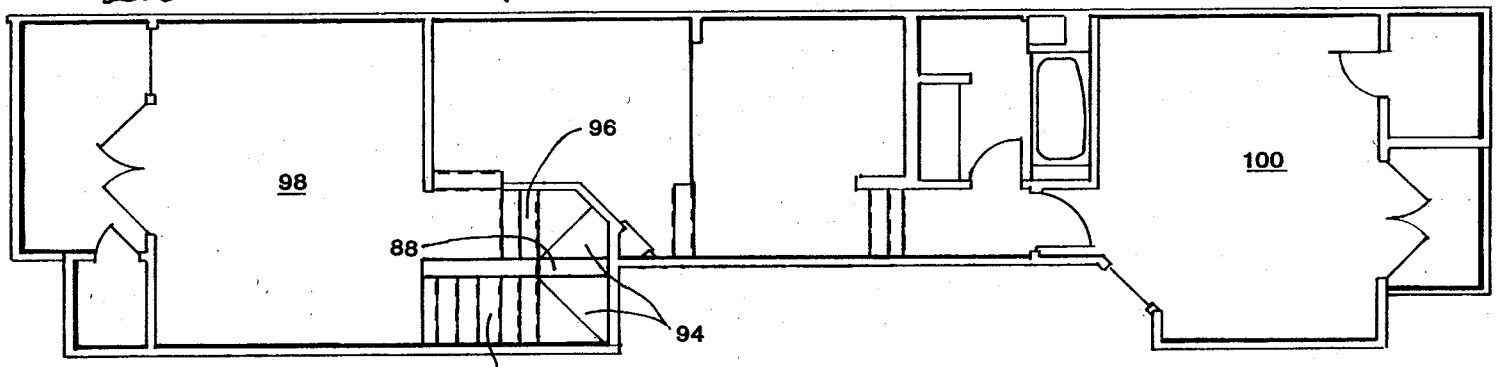
FIG. 6B is a plan view of the unit shown in FIG. 5B.
Figure 5C:
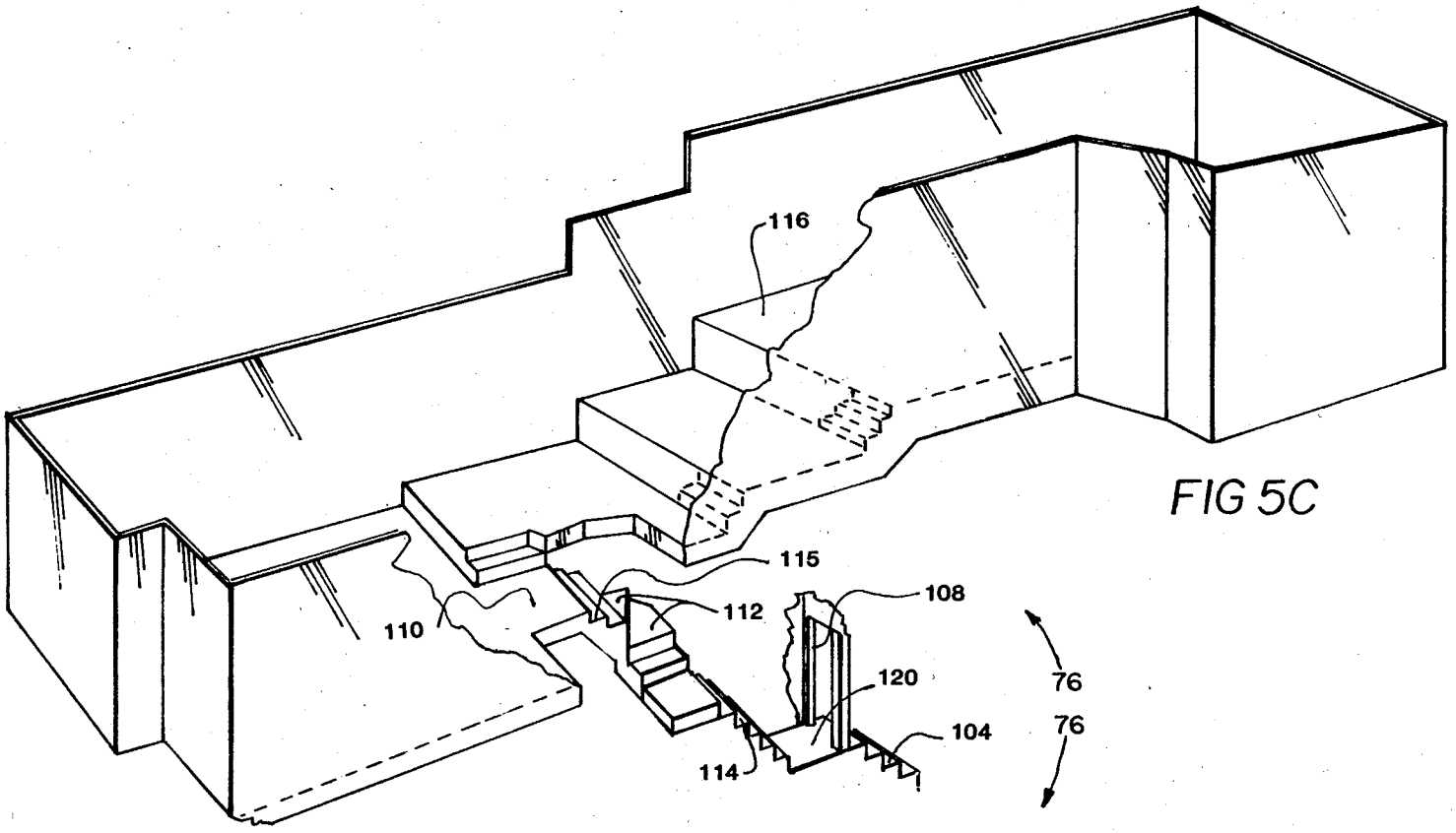
FIG. 5C is a perspective view of the upper dwelling unit of the embodiment of the structure shown in FIG. 5A.
Figure 6C:
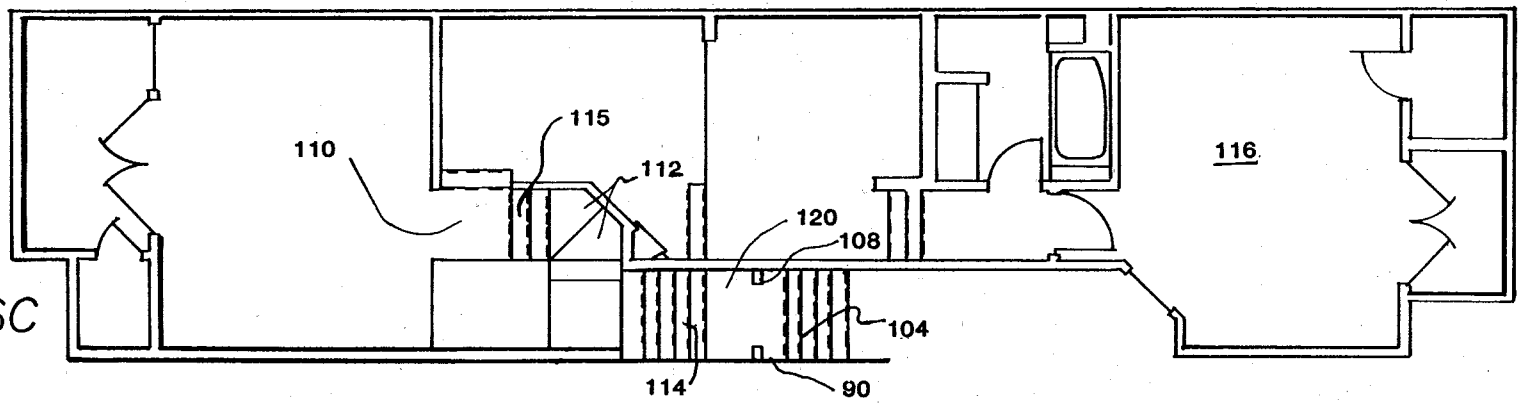
FIG. 6C is a plan view of the unit shown in FIG. 5C.

The interrelationship of the various interconnecting stairways in this embodiment of the multiple dwelling structure of the present invention are best shown in FIG. 4. It should be understood that FIG. 4 is not complete in terms of structure of the dwelling units (those details being shown in the previous figures), but rather shows only the individual stairways connecting the respective garage areas and lower and upper dwelling units, and those portions of the floors necessary to enable one skilled in the art to easily understand these relationships. As shown, the stairway 26 leading from the lower unit garage area 18 connects the garage area and the lower unit plaza area 28. The staircase 32 connects the lower unit plaza area 28 and the lower unit living, dining and kitchen area 34, and enters the area 34 at the location thereof shown by the phantom lines 62. Also as shown, the stairway 38 interconnects the lower unit living, dining and kitchen area 34 to the lower unit bedroom area 36.

The stairway 40 connects the upper unit garage area 20 with the upper unit plaza area 42. A stairway then leads from the upper unit plaza 42 by way of the twister 45, 49 to the upper living, dining and kitchen area 48. As shown, this upper unit staircase 46 is located directly above the corresponding lower unit staircase 32; therefore, the upper unit staircase 46 enters the upper unit living, dining and kitchen area 48 at exactly at the same location as in the lower unit, this location designated by the phantom lines 66 indicating the connection of the upper step of the staircase 46 with the upper unit living, dining and kitchen area 48. Those skilled in the art will appreciate that the upper unit staircase 46, being directly above the corresponding lower unit staircase 32, does not occupy any appreciable space of the lower unit. In this manner, even though the staircase 46 interconnecting the upper unit garage area 20 and the living, dining and kitchen area 48 passes "through" the floor plan of the lower unit, very little usable space is taken up in so doing.

In this first preferred embodiment, the lower dwelling unit 14 is shown as a smaller unit than the upper dwelling unit 6, the former having one bedroom and the latter having two bedrooms. Those skilled in the art will appreciate that each of the units may be essentially identical, or one of the units may be considerably larger than the other, resulting in either open or covered balconies on either end for either the upper or the lower unit.

A second preferred embodiment of the multiple dwelling structure of the present invention is shown in FIGS. 5–8. As in the first preferred embodiment of the multiple dwelling structure shown in FIGS. 1–4, this second preferred embodiment is constructed in the same sequence as the first preferred embodiment, that is the garage unit 72 (FIGS. 5A, 6A) is constructed first, with the lower dwelling unit 74 (FIGS. 5B, 6B) constructed directly above the garage unit and the upper dwelling unit 76 (FIGS. 5C, 6C) constructed directly above the lower dwelling unit. The garage unit 72 includes a lower garage area 78 and an upper garage area 80. These separate garage areas are located at a first ground level 82 and a second ground level 84, slightly elevated from the first ground level. These separate ground levels 82, 84 are attained by selective grading of the land prior to beginning construction on the dwelling structure. As in the first preferred embodiment, the second preferred embodiment incorporates the second ground level 84 at a level at least, and preferably approximately one-half story higher than the first ground level 82, in order to minimize the vertical distance between the ground level of the garage for the upper unit and the living area of the upper unit to no more than one and one-half stories.

The interconnecting stairways of the second preferred embodiment structure are slightly different from those of the first preferred embodiment. Considering first the ground level garage unit 72 (see FIGS. 5A and 6A), a staircase 86 leads up from the first ground level 82 to an optional doorway 88. This staircase 86 is enclosed by an outer wall 90 and main entranceway 92. The staircase 86 leads up to a lower unit double twister 94 which then is connected to a second stairway 96 (See FIG. 5B) connecting the twister with the lower unit living area 98. As in the first preferred embodiment, the staircase 86 leading from the lower garage area 78 to the lower dwelling unit 74, the double twister 94 and the staircase 96 leading from the double twister to the living area 98, define a separate, unique passageway interconnecting the garage area and the living space of the lower dwelling unit, which passageway is not in common with, or shared with, the passageway (stairway or walkway) connecting the garage area and living space of the upper dwelling unit 76.

Figure 7:
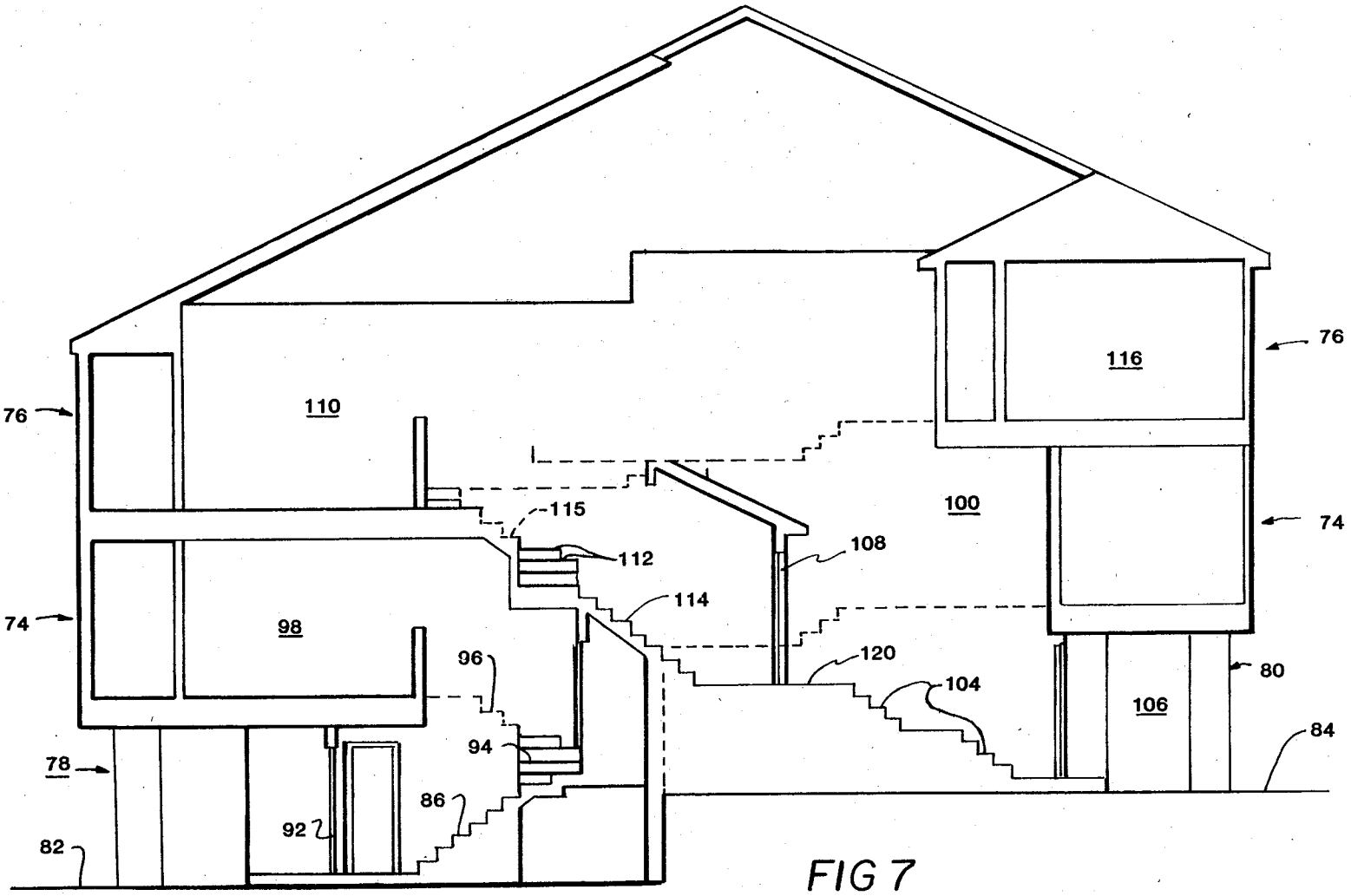
FIG. 7 is a side elevational view of the second preferred embodiment of the multiple-dwelling structure of the present invention.
Figure 8:
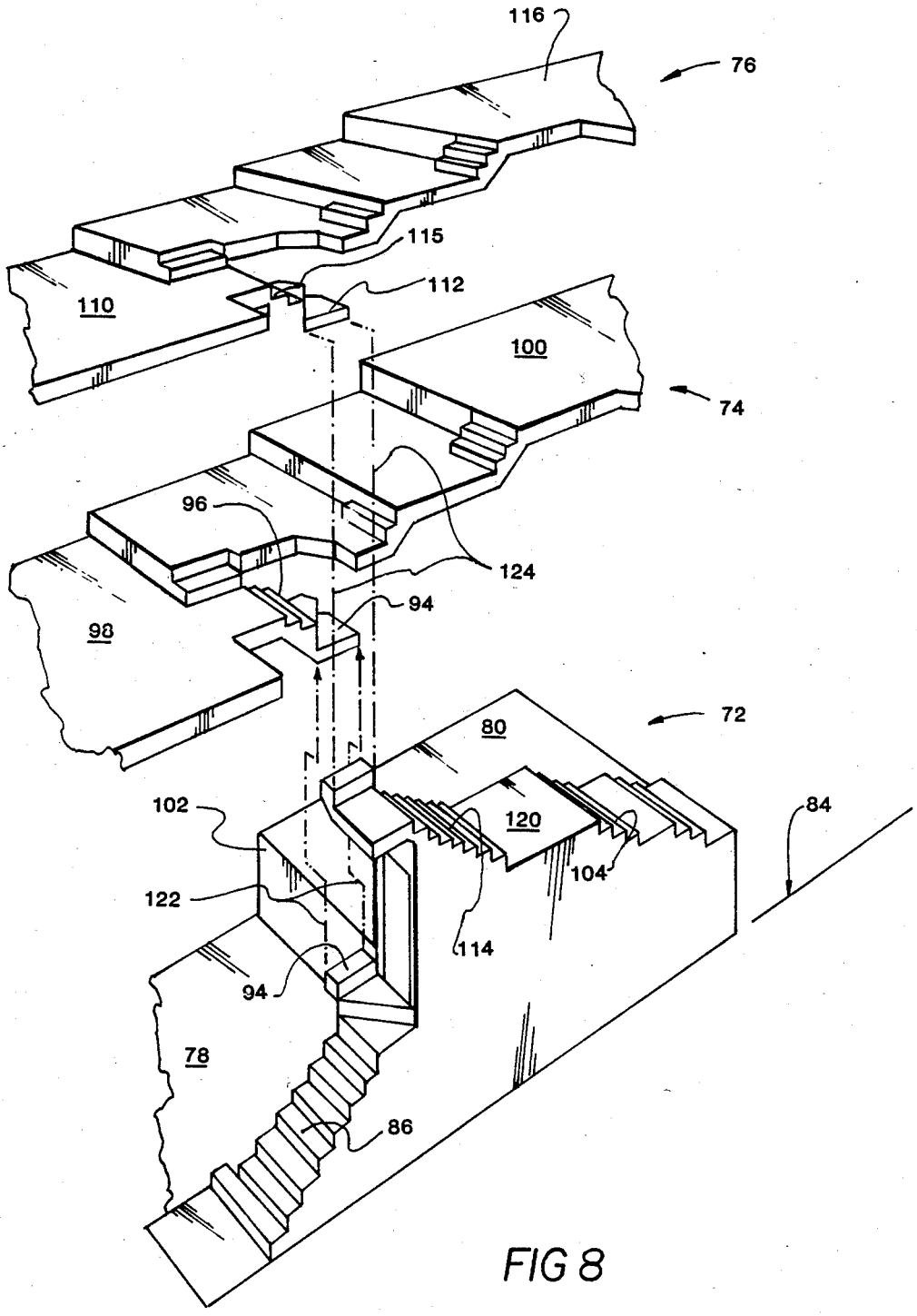
FIG. 8 is a perspective view of the floors of the garage unit, lower unit and upper unit, showing the relationship of the stairways interconnecting the respective garage areas and living areas of the second preferred embodiment of the multiple-dwelling structure of the present invention.

The lower unit living area 98 (See FIGS. 5B, 6B) is positioned directly above the lower garage area 78 at a first occupied level above the garage area which is approximately one-half story or less higher than the lower unit double twister 94. In this manner, from the level at the optional doorway 88, it is approximately one-half story down to the ground level of the garage area 78 and approximately one-half story or less up to the first occupied level of the living area 98. This concept is best shown in FIG. 7. Also, as best shown in FIG. 8, an additional feature of the present dwelling structure is that it incorporates a multi-level floor plan for the dwelling unit 74. Therefore, the rise is incremental, rather than continuous, between the living area 98 and the bedroom area 100.

Returning again to FIGS. 5A and 6A, the upper garage area 80 associated with the upper dwelling unit 76 is shown in essentially end-to-end relationship with the lower garage unit 78. As in the first preferred embodiment, a wall or partition 102 separates the garage areas 78, 80, the difference in the second preferred embodiment being that the garage areas are in abutting, although vertically offset, relation with each other, while in the first preferred embodiment the garage areas are laterally spaced apart, the structure of the first embodiment thus defining a space in between the garage areas which is capable of being utilized, for example, for housing heaters, laundry facilities, etc. The overall length of the multiple dwelling unit shown by the second preferred embodiment is consequently somewhat shorter than the overall length of the unit of the first preferred embodiment.

As in the lower garage area 78, the upper garage area 80 includes a staircase 104 connecting a garage door 106 with the upper unit main entranceway 108. (See FIG. 7) The upper unit main entranceway 108 is approximately one-half story above the second ground level 84, therefore approximately one story or less below the floor of the upper unit living area 110. The upper unit main entranceway 108 is positioned on a landing 120 which, as stated hereinabove, is approximately one story (or less) below the upper unit living area 110. A second staircase 115 leads up from the landing 120, through a twister 112, a staircase 115, and on up to the main living area 110. This staircase 115 is identical to and directly above the corresponding lower unit staircase 96 connecting the plaza area and living area.

As in the lower dwelling unit 74, the upper dwelling unit 76 incorporates a multi-level floor plan to provide an incremental rise between the upper unit living area 110 and the bedroom area 116 (FIG. 8). Additionally, as in the corresponding lower unit 74, the bedroom area 116 is approximately one-half story above the level of the living area 110.

The stairway 104 leading from the garage area to the upper unit main entranceway 108 is located physically outside of the garage area 80. Although the stairway 104 depicted in the drawings is shown as an exterior stairway leading up to a main entranceway 108 of the upper unit, it should be understood that alternatively, the external wall 90 may be extended in order to enclose the stairway 104 and the main entranceway 108 positioned at the bottom thereof to the right of the doorway 106 leading into the garage area, in order to totally enclose the garage area doorway within the main entranceway into the upper unit.

The upper unit staircase 104, 114, 115 from the ground level to the living area 110 includes a landing 120 approximately one-third of the way up. In the embodiment shown, the upper unit main entranceway 108 is positioned upon this landing 120. In this manner, the maximum distance from the main entranceway 108 to the living area 110 is one story or less. (See FIG. 7) It should be understood that the main entranceway 108 could be moved down to the ground level 84 of the garage, with the effect that the maximum distance from the main entranceway 108 to the living area 110 would be approximately one and one-half stories; and such variation is to be contemplated within the scope of the present invention. In this embodiment as shown (i.e., with the main entranceway 108 positioned upon the landing 120), the residents of the upper unit (effectively, the second story unit) travel up only approximately one story from the main entranceway 108 to the living area 110, as opposed to traveling up two stories in the instance of those residents living in typical second story units having parking areas below the first story units.

In this second preferred embodiment, the land could be contoured in the particular area of the stairway 104 to define sloping sidewalks to replace all or part of the staircase 104. This would not alter the effect of the upper dwelling unit having a maximum vertical distance between the main entranceway 108 and the living area 110 to be one and one-half stories.

The interrelationship of the various interconnecting stairways in this second preferred embodiment are best shown in FIG. 8. As in FIG. 4, FIG. 8 is not complete in terms of structure, but rather shows only the individual stairways connecting the respective garage areas and lower and upper dwelling units, and those portions of the floors necessary to enable one skilled in the art to easily understand these relationships. The stairway 86 leading up from the lower unit garage area 78 and main entranceway 92 connects the garage area and the lower unit double twister 94. This connection is shown by phantom lines 122. From the double twister 94, the stairway 96 leads up to the lower unit living area 98.

Regarding the upper unit, the exterior stairway 104 connects the upper unit garage area 80 with the upper unit twister 112, via the landing 120. This connection is shown by phantom lines 124. From there, the stairway 115 connects the twister 112 to the upper unit living area 110. As shown, this upper unit twister 112, interconnecting staircase 114 and living area 110 is directly above the corresponding double twister 94, interconnecting stairway 96 and living area 98 of the lower unit. Those skilled in the art will appreciate that because of the facts that (1) the stairway 104 is exterior to the living unit, and (2) the twisters 94, 112 are in vertical alignment with each other separated by one story, no usable space in the lower unit is taken up by the stairway from the upper unit garage area to its respective living area.

Those skilled in the art will also readily appreciate that the multiple-dwelling structure herein achieves all of the ends and objectives herein set forth. Specifically, the multiple-dwelling structure of the present invention provides a high density of units for a given area, each separate unit of the building (i.e., the upper or lower unit) having an individual garage area and a separate, unique stairway interconnecting the individual garage area to the individual living area, which stairway is totally separate from the interconnecting stairway of the other dwelling unit (i.e., the lower or upper unit), rather than sharing a number of common garage areas, stairways, hallways, or other passageways. Those skilled in the art will also readily appreciate that even though the individual dwelling units of the preferred embodiments of the multiple-dwelling structure of the present invention are constructed one on top of the other, with the garage areas being below both of the units, the distance between the level of the ground level entranceway to the living area of the upper dwelling unit is a maximum of one and one-half stories, and in the lower dwelling unit, this maximum distance is one story. In this manner, the multiple-dwelling structure of the present invention complies with typical city zoning and building regulations, while simultaneously therewith providing maximum individual security and privacy for the occupants of each individual dwelling unit.

As an additional feature of the multiple-dwelling unit of the present invention, each unit (i.e., both the lower unit and the upper unit) can be view oriented. Specifically, because of the design of the invention, facilitated by the fact that the stairways of each unit enter the respective units at corresponding locations of each unit, corresponding rooms (for example, the living rooms) of the units may be in direct vertical alignment, thus enabling the same exterior view from these corresponding rooms. This is possible even though, as described with respect to the first preferred embodiment, the stairway from the garage area to the living area of the upper unit passes "through" the lower unit.

Although preferred embodiments of the present invention have been disclosed in detail herein, it will be understood that various substitutions and modifications may be made to the preferred embodiments without departing from the scope and spirit of the present invention as recited in the appended claims.

The invention having been described, what is claimed is:

1. A multiple dwelling structure, comprising:
(a) lower and upper stacked living units,
(b) first and second garage areas respectively associated with said lower and upper living units, said first and second garage areas disposed in end-to-end relationship, with the vehicular access opening to said first garage area being at an opposite end to the vehicular access opening to said second garage area; and
(c) a first passageway interconnecting an entranceway to said lower living unit with said first garage area, a second passageway interconnecting an entranceway to said upper living unit with said second garage area; said first and second passageways being isolated from one another, and the general direction of traversal of the passageway from said first garage area to the entranceway to said lower living unit being in a direction opposite to the general direction of traversal of the passageway from said second garage area to the entranceway to said upper living unit;
(d) the grade level of said second garage area being higher than the grade level or said first garage area.

2. A multiple dwelling structure, comprising:
(a) lower and upper stacked living units,
(b) first and second garage areas respectively associated with said lower and upper living units, said first and second garage units disposed in end-to-end relationship, with the vehicular access opening to said first garage area being at an opposite end to the vehicular access opening to said second garage area; and
(c) a first passageway interconnecting an entranceway to said lower living unit with said first garage area, a second passageway interconnecting an entranceway to said upper living unit with said second garage area; said first and second passageways being isolated from one another, the beginning of said first passageway at said first garage area being laterally spaced from the beginning of said second passageway at said second garage area;
(d) the grade level of said second garage area being higher than the grade level of said first garage area.

3. The structure as set forth in claim 2 wherein the vertical distance between the grade level of said first garage area and the said entranceway to said lower living unit is no more than one story; and the vertical distance between the grade level of said second garage area and the said entranceway to said upper living unit is not more than one and one-half stories.

4. A multiple dwelling structure, comprising:
(a) lower and upper stacked living units, each of said units providing a residence dwelling separate from the other unit,
(b) first and second vehicular parking areas respectively associated with said lower and upper living units, said first and second parking areas disposed in end-to-end relationship, with the vehicular access opening to said first parking area being at an opposite end to the vehicular access opening to said second parking area; and
(c) first and second passageways, said first passageway extending from said first vehicular parking area to an entranceway to said lower living unit, said second passageway extending from said second vehicular parking area to an entranceway to said upper unit;
(d) said first and second passageways being isolated from one another to defined private walkways between each living unit and associated parking area which are not in common, nor shared, with one another.

5. The dwelling structure as set forth in claim 4 wherein said first and second vehicular parking areas are at respectively different grade levels.

6. The structure as set forth in claim 5, wherein the grade level of said second vehicular parking area is approximately one-half story higher than the grade level of said first vehicular parking area.

7. The dwelling structure as set forth in claim 5 wherein both of said lower and upper living units extend over at least a portion of both said first and second vehicular parking areas.

8. The structure as set forth in claim 7, wherein corresponding living areas of both living units are in vertical alignment.

9. The dwelling structure as set forth in claim 7 further comprising first and second plaza areas respectively associated with said first and second passageways, said first and second plaza areas being isolated from one another.

* * * * *

UNITED STATES PATENT AND TRADEMARK OFFICE

CERTIFICATE OF CORRECTION

PATENT NO. : 4,596,097

DATED : June 24, 1986

INVENTOR(S) : Jerry W. Stewart and W. Bryan Thruston

It is certified that error appears in the above-identified patent and that said Letters Patent is hereby corrected as shown below:

Claim 1, Col. 9, Line 38 - reads "or", should read "of"

Signed and Sealed this

Twenty-eighth Day of October, 1986

[SEAL]

*Attest:*

DONALD J. QUIGG

*Attesting Officer*

*Commissioner of Patents and Trademarks*